US005768674A

United States Patent [19]

Gasper et al.

[11] Patent Number: 5,768,674

[45] Date of Patent: Jun. 16, 1998

[54] APPARATUS FOR CREATING COPY RESTRICTIVE MEDIA

[75] Inventors: John Gasper, Hilton; Badhri Narayan, Rochester; Laurie L. Voci, Canandaigua, all of N.Y.

[73] Assignee: Eastman Kodak Company, Rochester, N.Y.

[21] Appl. No.: 846,387

[22] Filed: Apr. 30, 1997

[51] Int. Cl.[6] ..... G03G 21/04

[52] U.S. Cl. ..... 399/366; 283/902

[58] Field of Search ..... 399/366; 283/902; 355/133; 380/51

[56] References Cited

U.S. PATENT DOCUMENTS

| | | | |
|---|---|---|---|
| 3,852,088 | 12/1974 | Godlewski et al. | 283/902 X |
| 4,351,547 | 9/1982 | Brooks, II | 283/902 X |
| 4,678,322 | 7/1987 | Finkel et al. | 355/133 |
| 4,791,449 | 12/1988 | Foley et al. | 399/366 |
| 5,087,507 | 2/1992 | Heinzer | 283/902 X |
| 5,375,886 | 12/1994 | Tsuchiya | 283/902 X |
| 5,444,779 | 8/1995 | Daniele | 380/51 X |
| 5,647,010 | 7/1997 | Okubo et al. | 283/902 X |

*Primary Examiner*—Sandra L. Brase
*Attorney, Agent, or Firm*—Nelson A. Blish

[57] ABSTRACT

An apparatus for creating copy restrictive media is disclosed comprising a linear array (20) comprised of at least two spatially distributed light sources (22) and an aperture mask (28) for forming two or more micro-light sources from the light sources (22). An optical element (32) focuses light from the micro-light sources onto a media (40) moving relative to the linear array (20). An encoder (16) turns the light sources (22) on and off at regular intervals relating to movement of the media (40).

49 Claims, 8 Drawing Sheets

APPARATUS FOR CREATING COPY RESTRICTIVE MEDIA

CROSS REFERENCE TO RELATED APPLICATIONS

The present application is related to U.S. patent application Ser. No. 08/593,772, filed Sep. 28, 1995, by Jay S. Schildkraut, et al., and titled, "Copy Protection System"; U.S. patent application Ser. No. 08/598,785, filed Feb. 8, 1996, by John Gasper, et al., and titled, "Copy Restrictive Documents"; U.S. patent application Ser. No. 08/598,446, filed Feb. 08, 1996, by Xin Wen, and titled, "Copyright Protection In Color Thermal Prints"; U.S. patent application Ser. No. 08/598,778, filed Feb. 8, 1996, by John Gasper, et al., and titled, "Copy Restrictive System"; U.S. patent application Ser. No. to be assigned, filed Apr. 10, 1997, by John Gasper, et al. and entitled "Copy Restrictive System for Color-Reversal Documents", and U.S. patent application Ser. No. to be assigned, filed Apr. 10, 1997, by John Gasper, and entitled "Copy Restrictive Color-Reversal Documents".

FIELD OF THE INVENTION

The invention relates generally to the field of copy restriction, and in particular to an apparatus for applying microdots to media to restrict copying of material protected by copyright.

BACKGROUND OF THE INVENTION

Copying of documents has been performed since the first recording of information in document form. Documents are produced using many procedures on many types of substrates and incorporate many forms of information. Unauthorized copying of documents has also been occurring since the storage of information in document form first began. For much of the history of information documentation, the procedures used to copy original documents have been sufficiently cumbersome and costly to provide a significant impediment to unauthorized copying, thus limiting unauthorized copying to original documents of high value. However, in more recent times the introduction of new technologies for generating reproductions of original documents, for example has decreased the cost and inconvenience of copying documents, thus increasing the need for an effective method of inhibiting unauthorized copying of a broader range of restricted documents. The inability of convenient, low-cost copying technologies to copy original documents containing color or continuous tone pictorial information restricted unauthorized copying primarily to black-and-white documents containing textual information and line art. Recently, the introduction of cost effective document scanning and digital methods of signal processing and document reproduction have extended the ability to produce low cost copies of original documents to documents containing color and high quality pictorial information. It is now possible to produce essentially indistinguishable copies of any type of document quickly, conveniently, and cost effectively. Accordingly, the problem of unauthorized copying of original documents has been extended from simple black-and-white text to color documents, documents containing pictorial images, and photographic images. In particular, restricting the unauthorized duplication of photographic images produced by professional photographers on digital copying devices has recently become of great interest.

U.S. Pat. Nos. 5,193,853 and 5,018,767 by Wicker, disclose methods for restricting the unauthorized copying of original documents on devices utilizing opto-electronic scanning by incorporating spatially regular lines into the original document. The spacing of the lineations incorporated in the original document are carefully selected to produce Moiré patterns of low spatial frequency in the reproduced document allowing it to be easily distinguished from the original and degrading the usefulness of the reproduction. Although the Moiré patterns produced in the reproduced document are readily apparent to an observer, the required line pattern incorporated in the original document to produce the Moiré pattern upon copying is also apparent to an observer under normal conditions of use. Additionally, production of the Moiré pattern in the reproduced document requires that specific scanning pitches be employed by the copying device. Accordingly, this method of restricting unauthorized document copying is applicable only to documents such as currency or identification cards where the required line pattern can be incorporated without decreasing the usefulness of the document; application of this technique to high quality documents is unacceptable due to the degradation of quality and usefulness of the original document.

U.S. Pat. No. 5,444,779 by Daniele, discloses a method of preventing unauthorized copying by the printing of a two-dimensional encoded symbol in the original document. Upon scanning of the original document in an initial step of a copying process, the encoded symbol is detected in the digital representation of the original document and the copying process is either inhibited or allowed following billing of associated royalty fees. U.S. patent application Ser. No. 08/593,772, filed Sep. 28, 1995, by Schildkraut et al., and titled, "Copy Protection System," discloses the incorporation of a symbol of a defined shape and color into a document followed by detection of the symbol in a scanned representation of the document produced by the copying device. In both disclosures, the incorporated symbol is detectable by an observer under normal conditions of use and readily defeated by cropping the symbol from the original document prior to copying. In addition, incorporation of the symbol into the document is required in the generation of the original document leading to undesired inconvenience and additional cost. Accordingly, these methods of imparting restriction from unauthorized copying are unacceptable.

U.S. Pat. No. 5,390,003 by Yamaguchi, et al.; U.S. Pat. No. 5,379,093 by Hashimoto, et al.; and U.S. Pat. No. 5,231,663 by Earl, et al.; disclose methods of recognizing a copy restricted document by the scanning and analysis of some portion of the original document and comparison of the signal obtained with the signals stored in the copying device. When the signal of a copy restricted document is recognized, the copying process is inhibited. This method of restricting from the unauthorized copying of documents is limited in application because the signals of all documents to be copy restricted must be stored in or accessible by each copying device of interest. Because the number of potential documents to be copy restricted is extremely large and always increasing, it is impractical to maintain an updated signal database in the copying devices of interest.

Methods of encrypting a digital signal into a document produced by digital means have been disclosed. These methods introduce a signal which can be detected in a copying system utilizing document scanning and signal processing. These methods offer the advantage of not being detectable by an observer under normal conditions of use, thus maintaining the usefulness of high quality copy restricted documents. However, implementation of these methods is dependent on digital production of original documents. Although increasing, production of high quality documents using digital means is still limited. Accordingly, this approach is not useful for restricting the unauthorized copying of high quality documents produced using non-digital production methods.

U.S. Pat. No. 5,412,718 by Narasimhalu, et al.; discloses the use of a key associated with the physical properties of the document substrate which is required to decode the encrypted document. This method of restricting the unauthorized copying of documents is unacceptable for applications of interest to the present invention because it requires encryption of the original document rendering it useless prior to decoding.

U.S. application Ser. No. 08/598,778, filed Feb. 08, 1996 by John Gasper, et al., and titled, "Copy Restrictive System", and U.S. patent application Ser. No. 08/598,785, filed on Feb. 08, 1996, by John Gasper, et al., and entitled, "Copy Restrictive Documents" disclose pre-exposing color photographic paper to spots of blue light to produce an array of yellow microdots after chemical processing and a method of detecting these microdots during scanning performed by a digital printing device. Color photographic paper capable of forming yellow microdots after exposure to spots of blue light is of the color-negative type.

Finally, U.S. patent application Ser. No. to be assigned, filed Apr. 10, 1997, by John Gasper, et al., and entitled, "Copy Restrictive System For Color-Reversal Documents" and U.S. patent application Ser. No. to be assigned, also filed on Apr. 10, 1997, by John Gasper, and entitled, "Copy Restrictive Color-Reversal Documents" disclose pre-exposing color-reversal photographic paper to spots of blue light to produce an array of minus-yellow microdots after chemical processing and a method of detecting these microdots during scanning performed by a digital printing device.

Methods of exposing light-sensitive photographic media for the purpose of writing an image to the media are well-known in the art. Devices that write to the media by scanning a beam of light in raster fashion across the media are called flying spot scanners. These include cathode ray tubes (CRTs) and laser scanners. The intensity of the light beam is modulated in any of a number of ways during the scanning of the beam across the media. The image being written to the media is presented to the media as a continuous signal and the image occupies the full area of the media. The duty cycle of the light source expressed as a percentage of the time the light is on and being modulated in intensity is typically 100 percent. Such scanning printers are not designed for efficiently exposing photographic media to a sparse array of microdots requiring a duty cycle of less than 10 percent and preferably less then 5 percent. Although a laser scanner can use a pulsed laser to scan an image of low duty cycle, they occupy a large volume, are expensive to build, operate, and maintain, and are designed to scan only across a limited length of scan line usually measured in inches and not feet when the writing spot size is submillimeter in diameter.

SUMMARY OF THE INVENTION

An object of the present invention is to provide an apparatus to efficiently expose photographic media to a sparse array of microspots of colored light with precise two-dimensional spacing, intensity, and size.

Another feature of the invention is the use of solid state light emitters that offer controllable and stable light emission and a long operational lifetime.

An additional object of the invention is to provide a light source having a narrow spectral bandwidth.

Another object of the invention is to use multiple, individually addressable solid state light sources distributed sparsely along a line across a direction of motion of a media.

Another feature of the invention is the ability to precisely align and space solid state light emitters along a line and to synchronize the light pulses to generate a sparse array of microspots of colored light with a precise spacing in an orthogonal directions, to enable a software algorithm in a digital copier to perform a discrete Fourier transform to verify the specific pitch of the two-dimensional array of microdots subsequently formed in the image created by the end user of the media after chemical processing of the media.

Still another object of the invention is adjusting the radiant power emitted by individual light sources so as to provide a constant exposure intensity when additional optical elements are positioned between the light sources and the photographic media and when the output of the light sources varies for a fixed input power.

The present invention is directed to overcoming one or more of the problems set forth above. Briefly summarized, according to one aspect of the present invention, there is provided an apparatus for creating copy restrictive media comprising a linear array comprised of at least two spatially distributed light sources and an aperture mask for forming two or more micro-light sources from the light sources. An optical element focuses light from the micro-light sources onto a media moving relative to the linear array. An encoding turns the light sources on and off at regular intervals relating to movement of the media.

These and other aspects, objects, features, and advantages of the present invention will be more clearly understood and appreciated from a review of the following detailed description of the preferred embodiments and appended claims, and by reference to the accompanying drawings.

ADVANTAGEOUS EFFECT OF THE INVENTION

The exposing apparatus of the present invention provides a very compact printhead for efficiently exposing a sparse array of microspots of colored light to a moving web of photographic media immediately after coating of the web to light-sensitive emulsions. The compact print head fits into the tight confinement of existing coating machines without costly retrofitting and allows the exposure of the full width of the web for the full duration of the coating at the required coating speeds with consistently repeatable performance. The media can then be slit to any desired width and chopped to any paper size with assurance that the copy restrictive feature provided by the stable latent image of microdots exists in all paper sizes used by the end customer.

DETAILED DESCRIPTION OF THE INVENTION

Figure 1:
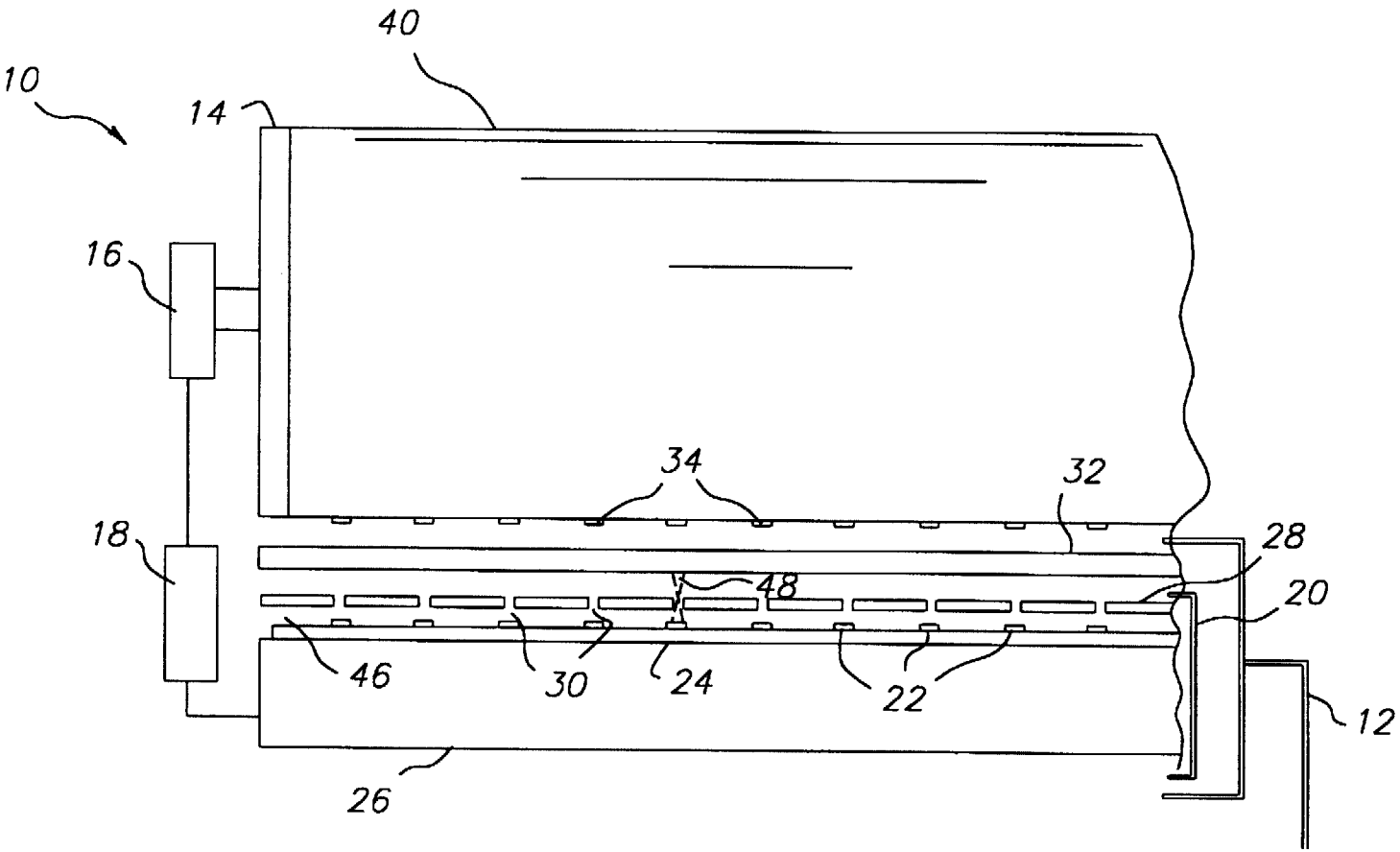
FIG. 1 is a plan view of an apparatus with a linear array of light emitting diodes (LED) according to the present invention.

Referring to FIG. 1, in its most general implementation, the inventive apparatus 10 to imparts to color photographic media and in particular color photographic paper a means of copyright protection. Apparatus 10 is comprised of a printhead 12, drum 14, encoder 16, electronic controller 18.

Printhead 12 is comprised of a linear array of light sources 20, aperture mask 28, and lens array 32. The linear array of light sources is composed of spaced, light emitting sources 22 such as inorganic or organic light-emitting diodes (LEDs) or laser diodes, that emit predominantly blue light in the range of wavelengths from 400 to 500 nanometers. The light emitting sources 22 are mounted on a ceramic or appropriate heat sink 24 which in turn is mounted on to a rigid metal base mount 26. Each of the light emitting sources 22 are separated from each adjacent source by at least 0.5 mm and preferably 1 mm. Each light emitting source has a maximum linear dimension of 0.3 mm, and preferably less than 0.2 mm.

Figure 2:
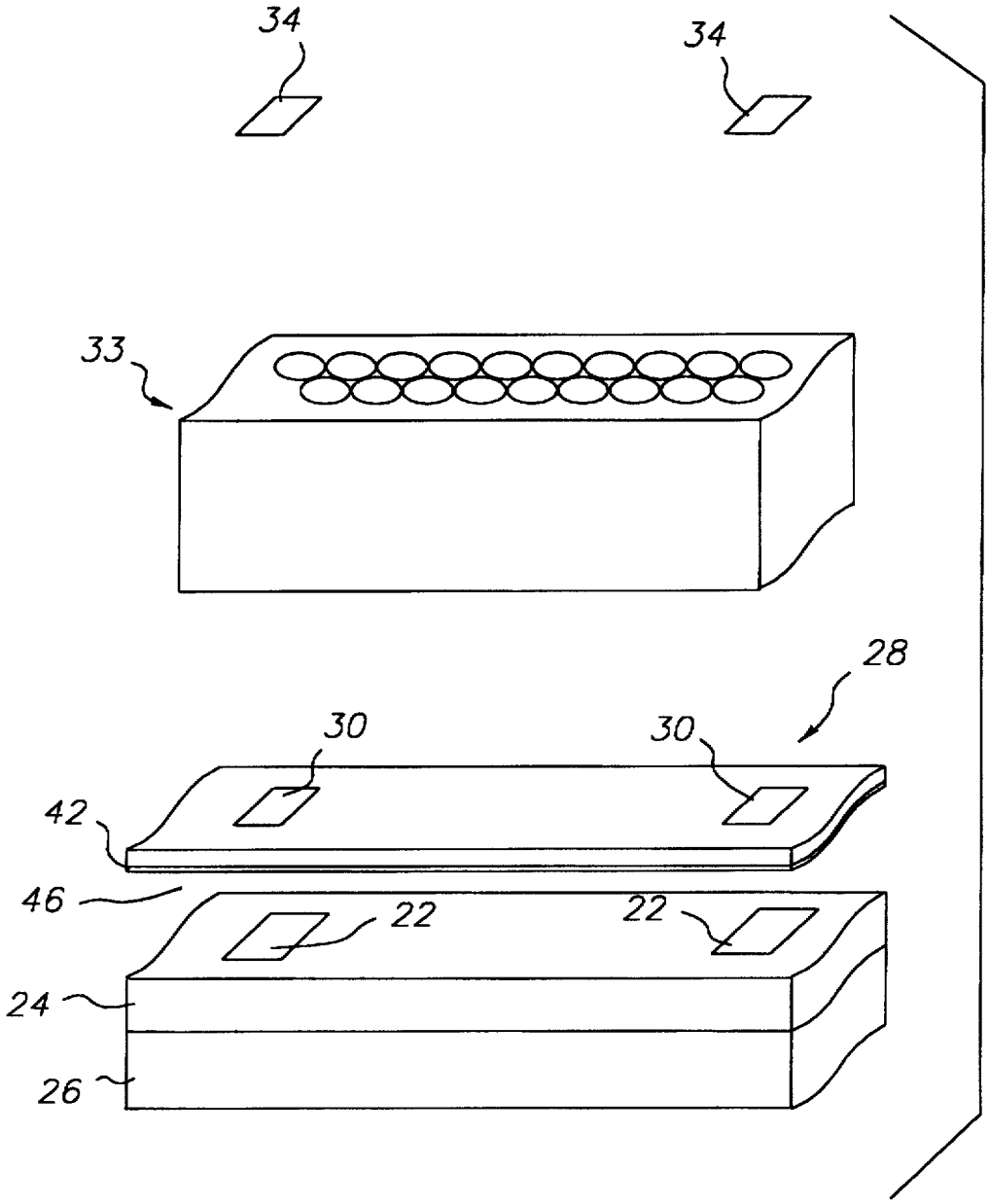
FIG. 2 is a perspective view of lens array and aperture mask for the apparatus shown in FIG. 1.

As shown in more detail in FIG. 2, the light from each light source 22 illuminates an appropriate aperture 30, in aperture mask 28, placed over each light source 22. The illuminated aperture is then imaged by a lens array 32 to a light sensitive media 40. In the preferred embodiment, lens array 32 is a gradient-index rod lens array 33 sold under the trademark Selfoc™, made by NSG America. In an alternate embodiment lens array 32 is a microlens array 35 of the type shown in FIG. 3.

Each aperture 30 in the aperture mask 28 is used to restrict the area of the emitted light that is being imaged onto the light sensitive media 40 so as to form a micro-spot 34 of focused light of a desired size on the media 40. Each aperture 30 is separated from each adjacent aperture by at least 0.5 mm and preferably 1 mm. Each aperture has a maximum linear dimension of 0.2 mm, and preferably less than 0.1 mm. A center of each aperture in the aperture mask is aligned coaxially with a center of each light source. After chemical processing of the exposed media, a colored microdot is formed in the color photographic media.

Figure 3:
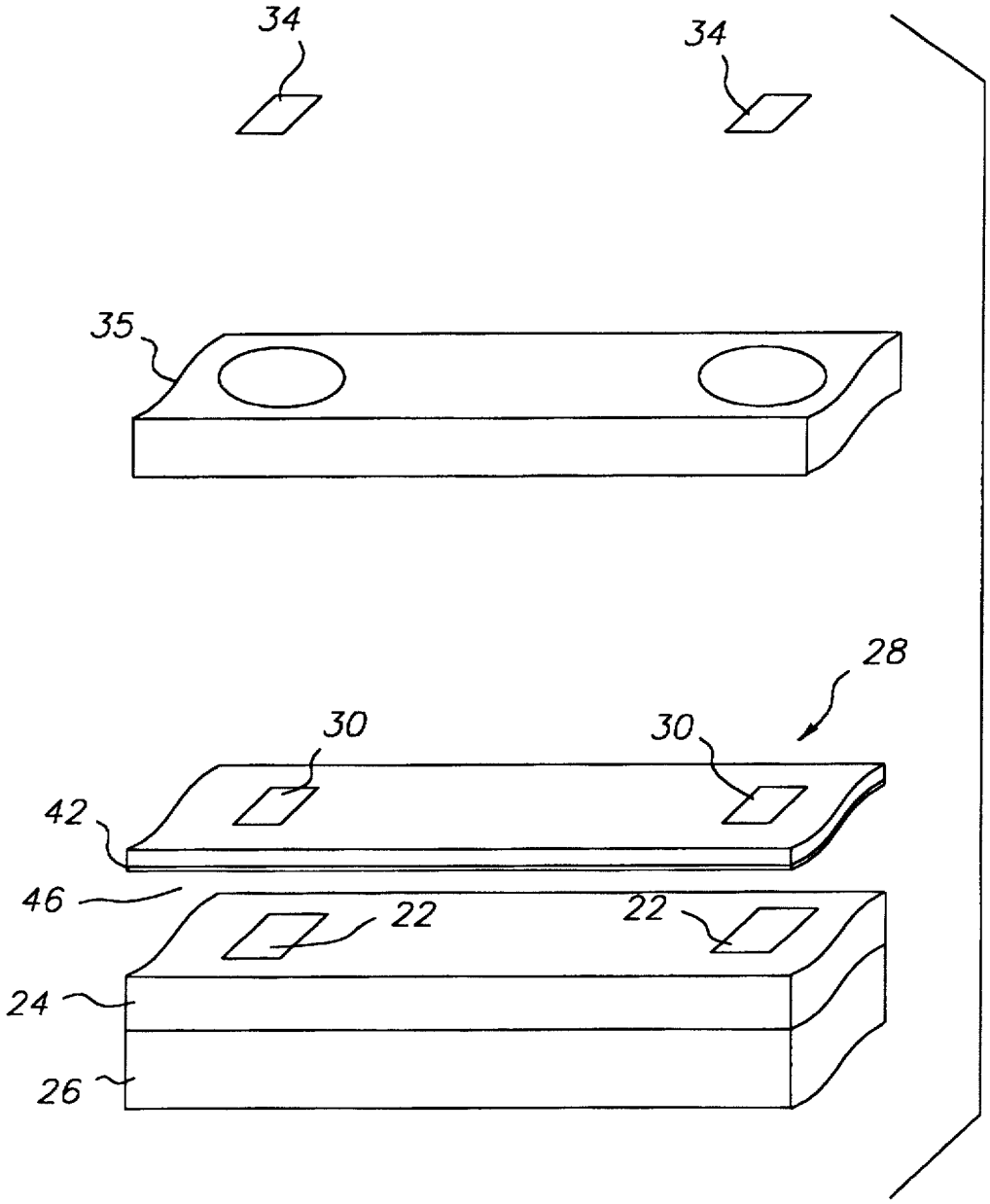
FIG. 3 is a perspective view of an alternate embodiment of a lens array for the apparatus shown in FIG. 1.

Aperture mask 28 is separated from the linear array of light sources 20 by a gap 46 shown in FIG. 1–3. In the preferred embodiment gap 46 is at least 0.1 mm. Gap 46 provides a reduction in the angle subtended 48 by the light passing through the aperture, thereby reducing the working numerical aperture of the imaging optics to provide a sharper image with less flare and increased depth-of-focus than would otherwise be possible.

Also, the aperture mask may be coated with a filter material 42 that provides spectral filtration to block unwanted wavelengths of light. Filter material 42 may be placed anywhere between light sources 22 and the lens array 32. In one embodiment filter material is a multi-layer, dielectric, interference filter, and is coated on one surface of aperture mask 28.

The separation of the light emitting sources 22, and the concomitant separation of the apertures 30, determines the spacing between the micro-spots 34 of blue light in a transverse direction i.e. across the width of the media 40. To control the precise placement of micro-spots 34 in a longitudinal direction, a high resolution encoder 16 is mounted on drum 14. The drum 14 transports media 40. Encoder pulses are counted by electronic controller 18 to generate electrical timing signals necessary to pulse the linear array of light sources 20 at a precise pulse duration at precise intervals of time. For a given radiant power emitted by the light sources 22, the duration of the pulse (the time that the light source is on) is variable to obtain a desired exposure on the photographic media. The encoder 16 provides precise timing pulses irrespective of any media flutter, which enables precise location of the microdots at a desired pitch in the longitudinal direction. In some embodiments, it is desirable to keep the pitch of the micro-spots along the transverse and longitudinal directions the same.

By controlling the light pulse duration, the radiant power output from the light emitting sources 22, and the size of the aperture 30, a size and intensity of the micro-spot is controlled. The resulting controlled exposure received by the photographic media results in a two-dimensional array of micro-spots of desired size and exposure to the media After chemical processing of the media there is formed in the media colored microdots of the desired size, spacing, and optical density.

One of the important attributes of the present invention is the precise placement of the micro-spots of focused light onto the media. After exposure and chemical processing of silver halide photosensitive media, an image subsequently recorded by an end user will contain microdots of the same spacing. This photographic print is rendered copy restrictive. When an attempt is made to copy the print using a digital printing station, detection means for identifying the unique pattern of microdots enables preventing operation of the digital print station. An important aspect of this detection means is the performance of a Fourier transform to identify the spatial frequency or frequencies of the two-dimensional pattern. Without accurate positioning of the micro-spots of light onto the media with adequate precision and repeatability of location, as well as maintaining a constant radiant energy for all micro-spots for all exposed media, it would be far more difficult to develop a robust software algorithm having a high probability of detecting a pattern that identifies the media as copy restrictive when this pattern is accompanied by a complex scene imparted to the media by the end user.

Another important aspect of the present invention is maintaining an equal radiant energy to the media for all micro-spots. In the preferred embodiment employing LEDs, an aperture mask, and a Selfoc™ array, it is necessary to adjust the applied voltage to each LED in order to obtain an equal energy exposing the media. This is in part due to variations in the operating characteristics from one LED to another, variation in the open area of the apertures from one aperture to another, and a variation in the brightness of the Selfoc™ image when the position of each micro-light source varies with respect to the spatial arrangement of the gradient-index rod lenses in the Selfoc™ linear array.

Another important feature of the present invention is the exposure of the media with a sparse array of micro-spots covering typically less than 1% of the surface area. This is necessary to prevent an increase in the minimum optical density of the media. Therefore, the duty cycle of the light sources, i.e., the fraction of the time the light source is on and exposing the media is very low, typically less than 5%. This low duty cycle provides extended operating life for the LEDs or laser diodes.

Figure 4:
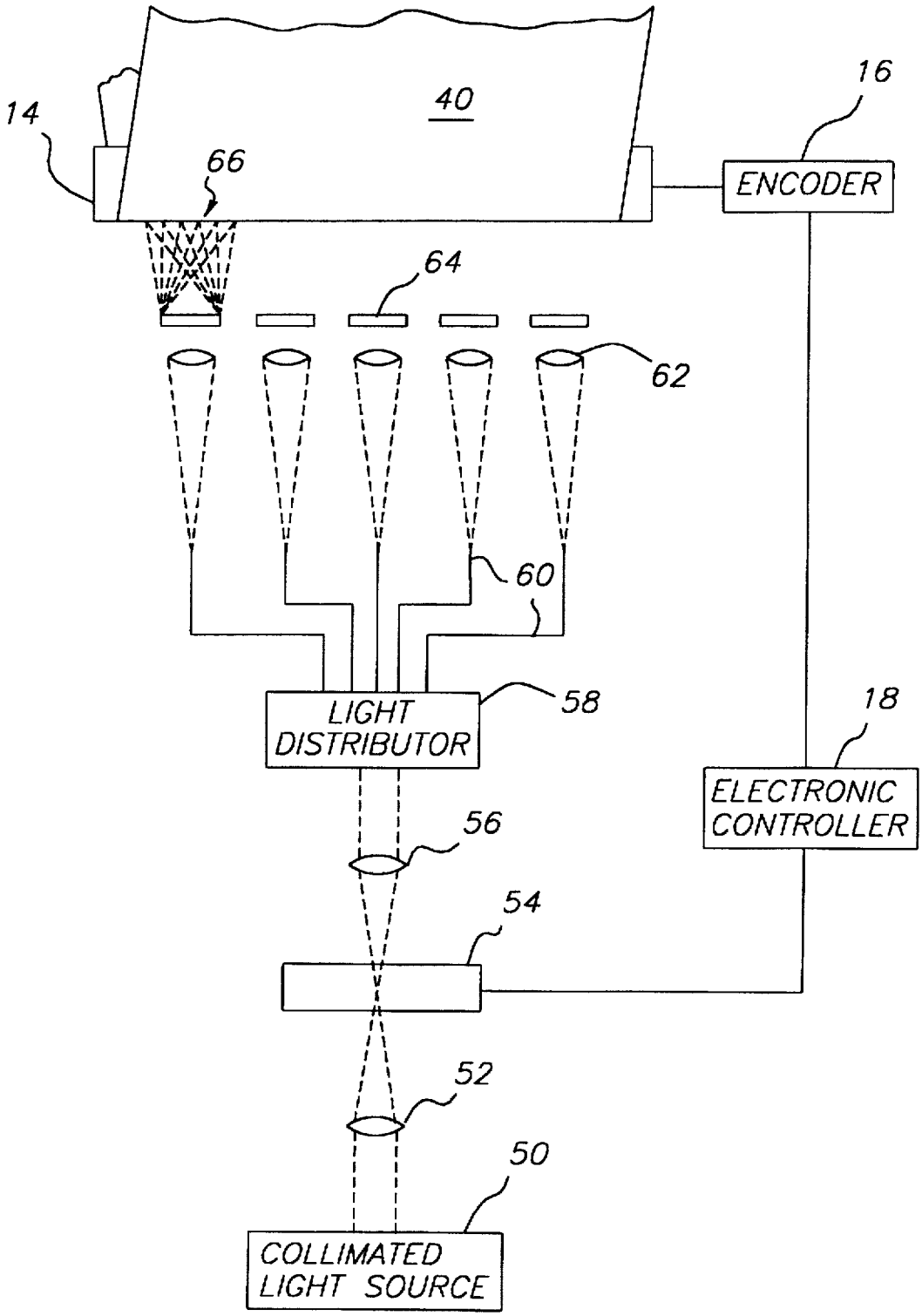
FIG. 4 is a plan view of another embodiment of the invention using optical fibers and a Dammann filter.

FIG. 4 shows an alternate embodiment of an apparatus for creating copy restrictive media comprising a collimated light source 50, focused to a light modulator 54, recollimated to a light distributor 58, which distributes light to multiple optical fibers 60. The distal ends of the optical fibers 60 are aligned into a widely spaced linear array at a common plane. Light from the distal end of each of the optical fibers 60 is focused by a lens 62. A Dammann filter 64 positioned adjacent to each lens 62 forms at least two micro-spots 66 along a line transverse to a direction of travel of the media 40. Encoder 16 and electronic controller 18 function as described above.

Figure 5:
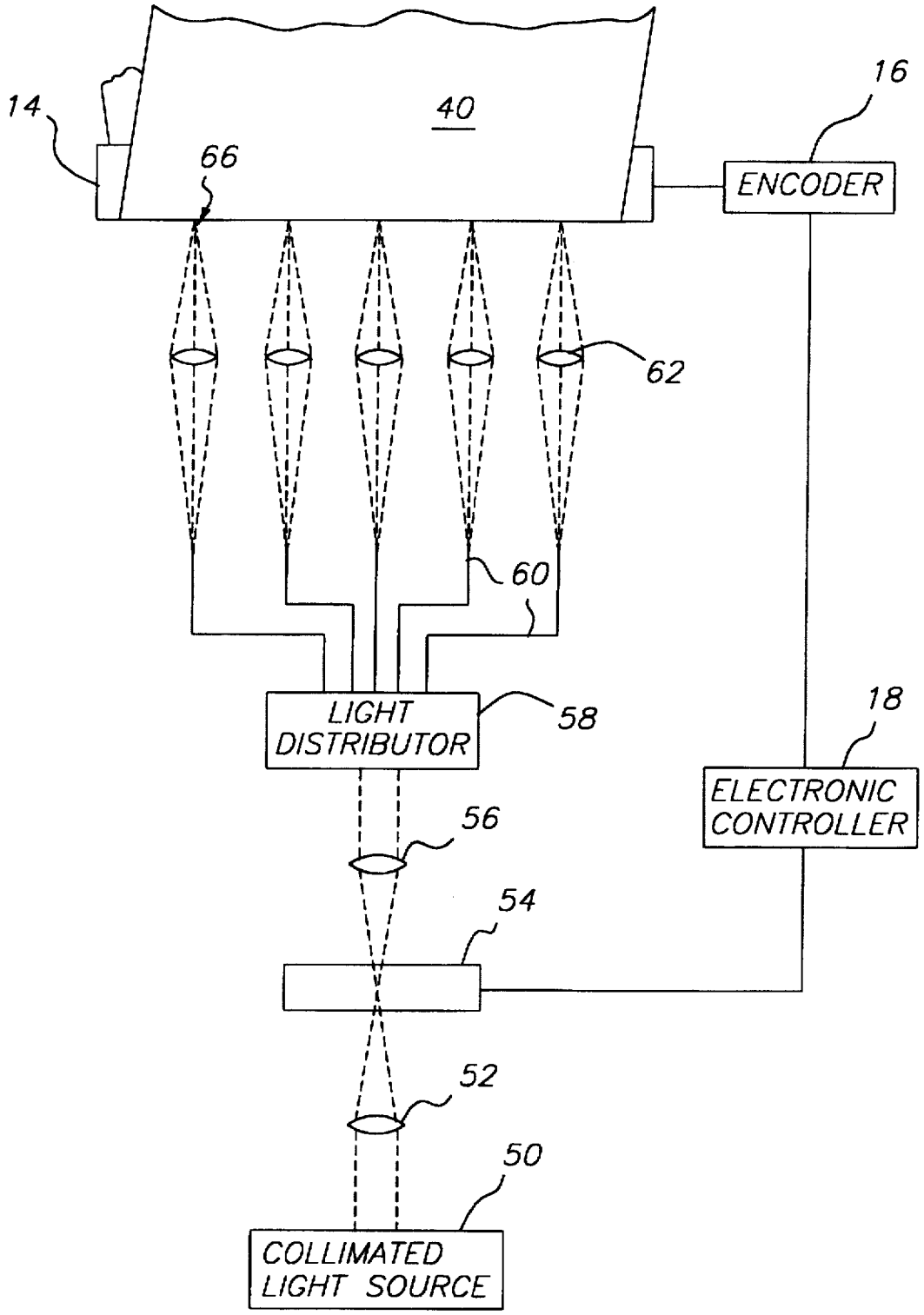
FIG. 5 is a plan view of yet another embodiment of the invention using a micro lens array.

FIG. 5 shows another embodiment of an apparatus for creating copy restrictive media comprising a collimated light source 50, focused to a light modulator 54, recollimated to a light distributor 58, which distributes light to multiple optical fibers 60. The distal ends of the optical fibers 60 are aligned into a widely spaced linear array at a common plane. Light from the distal end of each of the optical fibers 60 is focused by a lens 62 to the media 40 to form a micro-spot 66 along a line transverse to the direction of travel of the media 40. Encoder 16 and electronic controller 18 function as described above.

Figure 6:
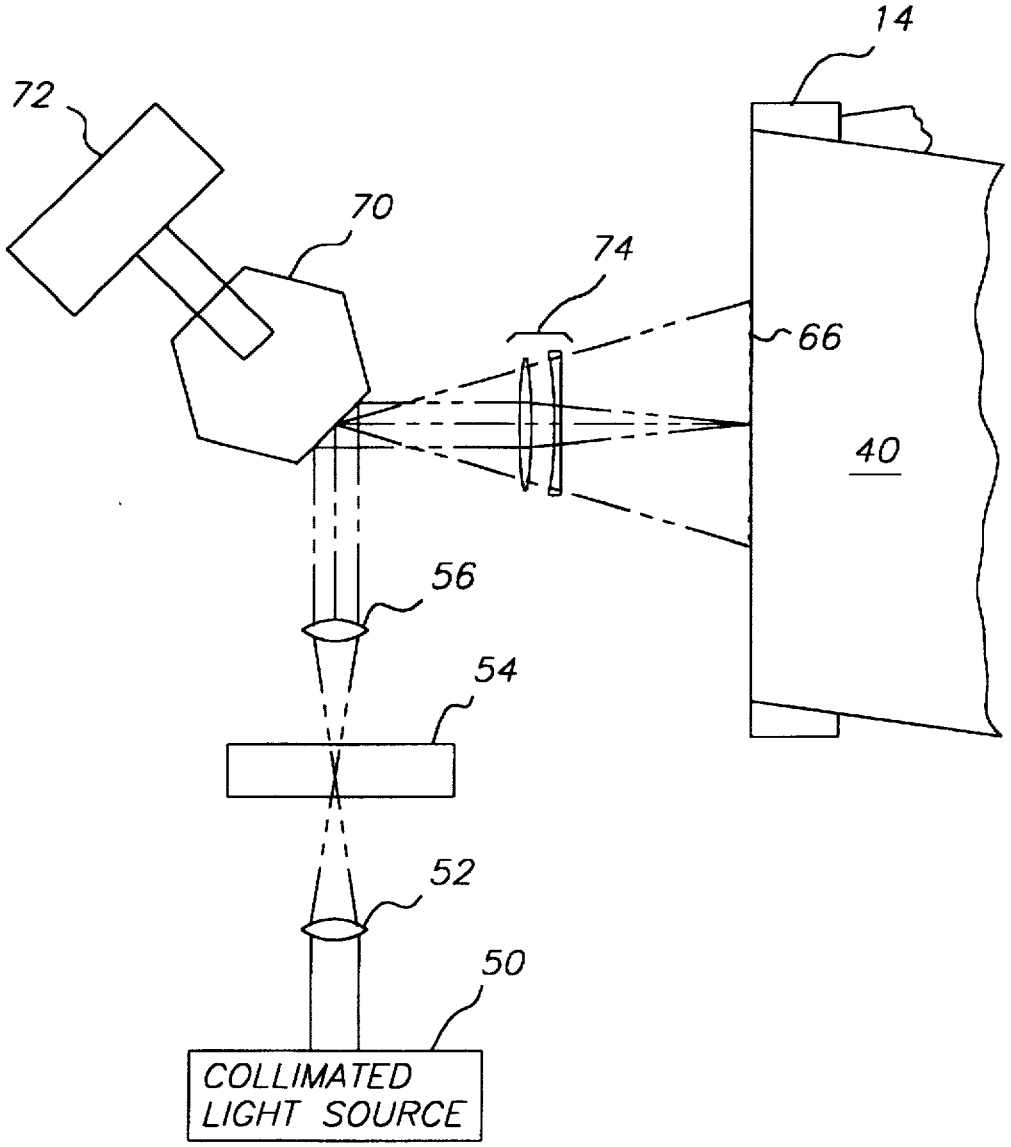
FIG. 6 is a plan view of an alternate embodiment of the invention using a rotating polygon.

FIG. 6 shows yet another embodiment of an apparatus for creating copy restrictive media comprising a collimated light source 50, focused to a light modulator 54, recollimated by a lens 56. The collimated beam is scanned across media 40 by rotating polygon 70. An f-theta lens 74, located between polygon 70 and media 40, focuses the scanning beam to micro-spots 66 in a direction transverse to the direction of travel of the media. Driver 72 rotates polygon 70. Encoder 16 and electronic controller 18 function as described above.

Figure 7:
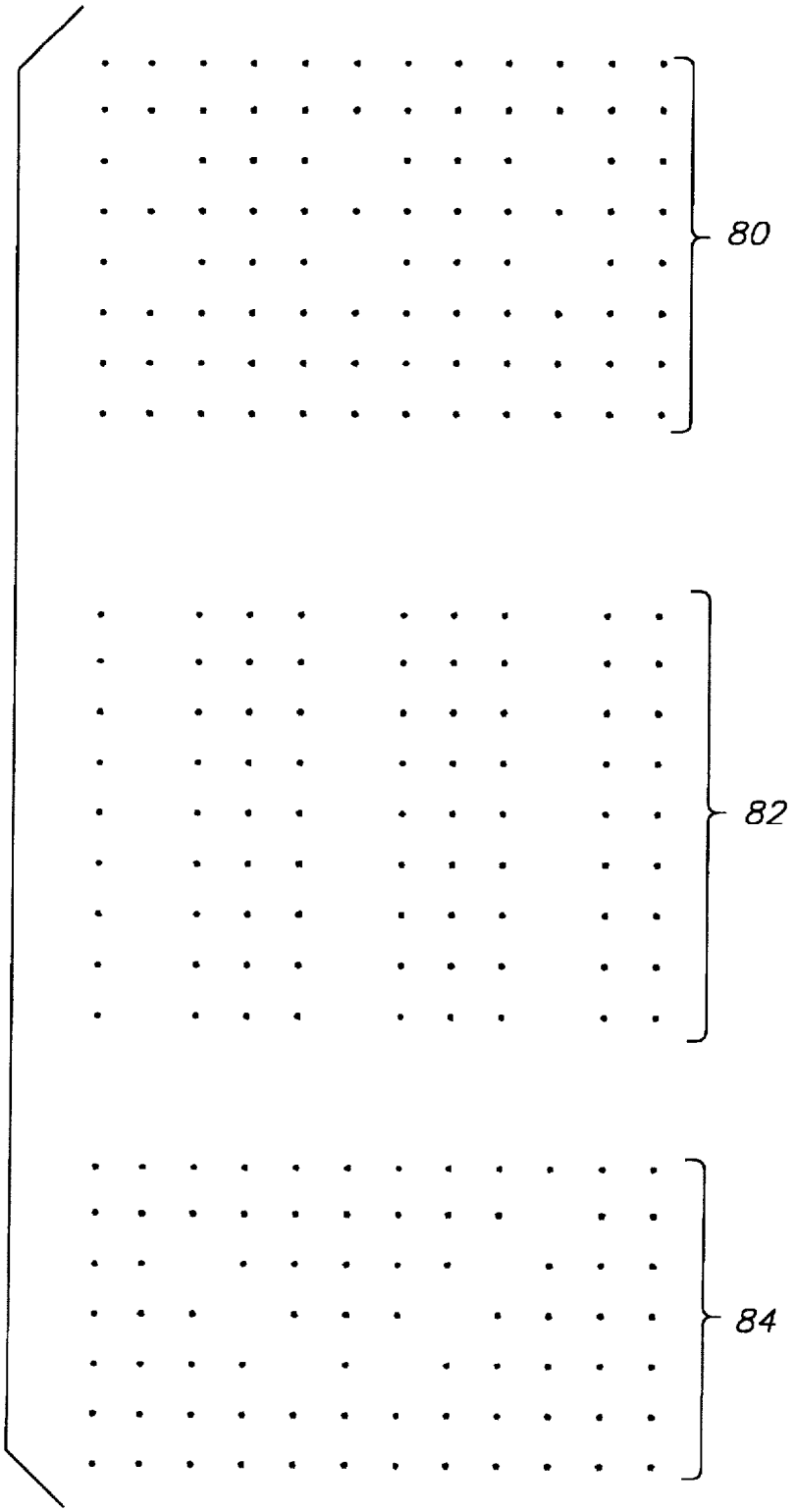
FIG. 7 is a plan view of a pattern of microdots that may be produced by the apparatus in FIG. 1.

Referring to FIG. 7, a series of micro-spot patterns 80, 82, and 84 are shown. These patterns are produced by an LED apparatus such as shown in FIG. 1 and demonstrate that specific patterns may be produced by writing a unique sequence of pulses from selected LEDs as in 82. The pattern produced in 82 is achieved by not exposing with an ordered sequence of LEDs. The pattern in 84 is produced by turning off LEDs in a staggered sequence.

Figure 8:
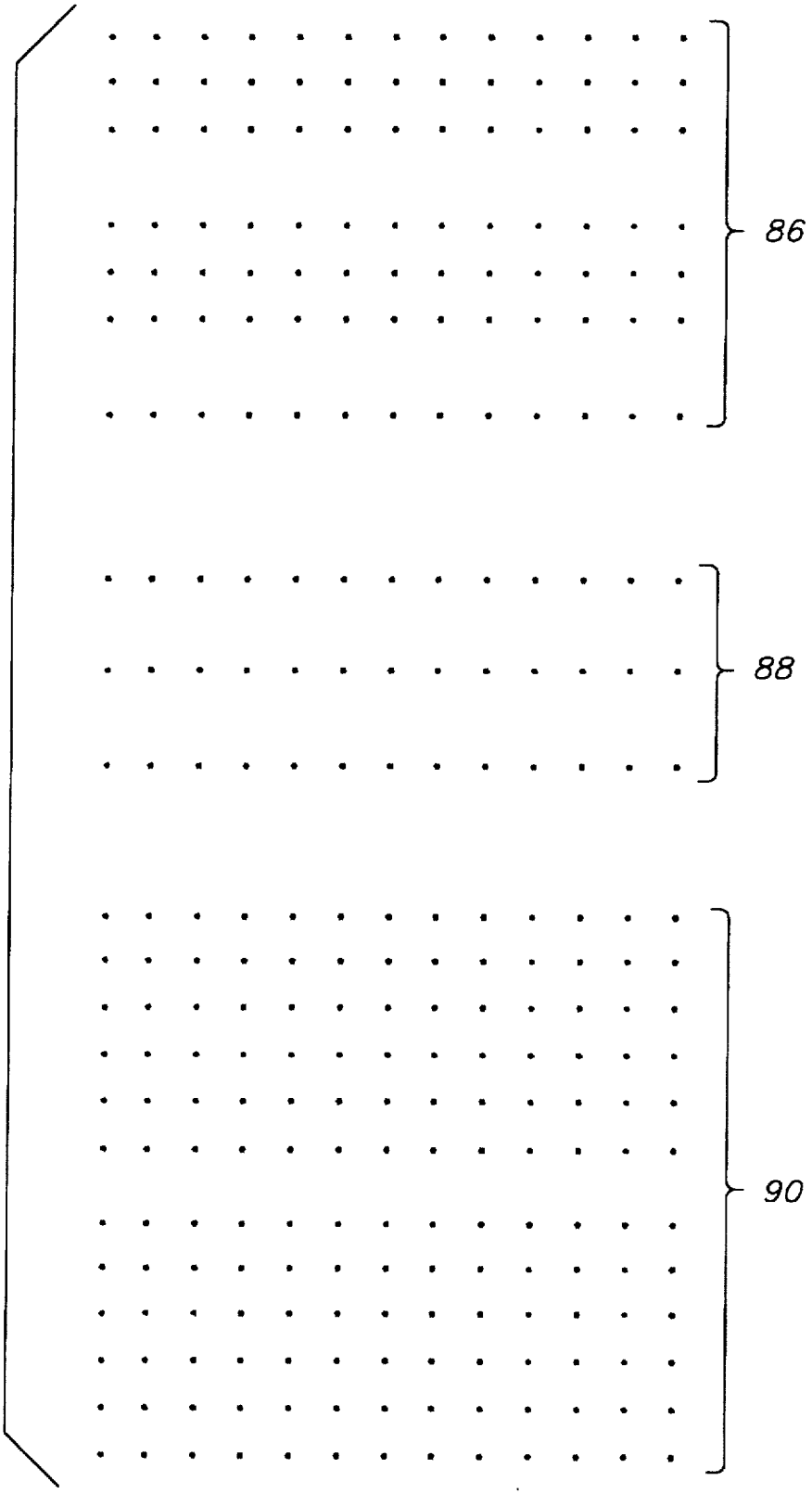
FIG. 8 is a plan view of a pattern of microdots that may be produced by the apparatus in FIGS. 1, 4, and 5.

Referring to FIG. 8, a series of micro-spot patterns 86, 88, and 90 are shown. These patterns are produced by a collimated light source, such as the apparatus shown in FIGS. 4–6. These patterns show some of the patterns that may be produced by writing a unique sequence of pulses from the modulated light source. The pattern in 86 shows every fourth row deleted, the pattern in 88 shows every other row deleted, and the pattern in 90 shows every seventh row deleted.

The invention has been described in detail with particular reference to certain preferred embodiments thereof, but it will be understood that variations and modifications can be effected within the spirit and scope of the invention.

PARTS LIST

10 the inventive apparatus
12 printhead
14 drum
16 encoder
18 electronic controller
20 linear array
22 light emitting sources
24 ceramic or appropriate heat sink
26 metal base mount
28 aperture mask
30 apertures
32 lens array
33 gradient-index rod lens array
34 micro-spot
35 microlens array
40 light sensitive media
42 filter material
46 gap
48 angle subtended
50 collimated light source
52 lens
54 modulator
56 lens
58 light distributor
60 optical fiber
62 lens
64 Dammann filter
66 focused micro-spots
70 polygon
72 driver
74 f-theta lens
80 unique pattern
82 unique pattern
84 unique pattern
86 unique pattern
88 unique pattern
90 unique pattern

What is claimed is:

1. An apparatus for creating copy restrictive media comprising:

a linear array comprised of at least two spatially distributed light sources;

an aperture mask for forming two or more micro-light sources from said light sources;

an optical element for focusing light from said micro-light sources onto a media moving transverse to said linear array; and an encoder for turning said light sources on and off at regular intervals relating to movement of said media.

2. An apparatus for creating copy restrictive media as in claim 1 wherein said light sources have a duty cycle of less than 10 percent.

3. An apparatus for creating copy restrictive media as in claim 1 wherein each of said light sources are spaced at a distance of at least 0.5 mm center-to-center.

4. An apparatus for creating copy restrictive media as in claim 1 wherein a maximum linear dimension of each of said light sources is 0.3 mm.

5. An apparatus for creating copy restrictive media as in claim 1 wherein said light sources are LEDs.

6. An apparatus for creating copy restrictive media as in claim 5 wherein said LEDs produce a blue light.

7. An apparatus for creating copy restrictive media as in claim 6 wherein a spectral filter restricts a spectral emission of said LEDs.

8. An apparatus for creating copy restrictive media as in claim 7 wherein the voltage applied to each LEDs is adjusted to obtain an equal radiant energy to the media after passage of the radiant energy through each aperture of said aperture mask and said optical element.

9. An apparatus for creating copy restrictive media as in claim 1 wherein said light sources are diode lasers.

10. An apparatus for creating copy restrictive media as in claim 9 wherein the voltage applied to each diode laser is adjusted to obtain an equal radiant energy to the media after passage of the radiant energy through each aperture of said aperture mask and said optical element.

11. An apparatus for creating copy restrictive media as in claim 9 wherein said laser diodes produce a blue light.

12. An apparatus for creating copy restrictive media as in claim 1 wherein each aperture in said aperture mask is arranged to form a linear array.

13. An apparatus for creating copy restrictive media as in claim 1 wherein each aperture in said aperture mask is spaced from an adjacent aperture a distance of at least 0.5 mm center-to-center.

14. An apparatus for creating copy restrictive media as in claim 1 wherein a maximum linear dimension of each aperture in said aperture mask is less than 0.2 mm.

15. An apparatus for creating copy restrictive media as in claim 1 wherein a gap between said aperture mask and said light source is greater than 0.1 mm.

16. An apparatus for creating copy restrictive media as in claim 1 wherein a gap between said aperture mask and said light source provides a reduction in the angle subtended by light passing through each aperture of said aperture mask.

17. An apparatus for creating copy restrictive media as in claim 1 wherein a center of each aperture in said aperture mask is coaxial with a center of each light source.

18. An apparatus for creating copy restrictive media as in claim 1 wherein a maximum linear dimension of each aperture in said aperture mask is less than a maximum linear dimension of each light source.

19. An apparatus for creating copy restrictive media as in claim 1 wherein said optical element for focusing said micro-light sources is a linear array of one or more rows of close-packed gradient-index rod lenses.

20. An apparatus for creating copy restrictive media as in claim 1 wherein said optical element for focusing said micro-light sources is a linear array of microlenses.

21. An apparatus for creating copy restrictive media as in claim 20 wherein a center of each microlens in said linear array of microlenses is aligned coaxially with a center of each aperture in said aperture mask.

22. An apparatus for creating copy restrictive media as in claim 1 wherein the delay between pulses of equal duration is modified for one or more light sources to enable writing to the media a unique pattern.

23. An apparatus for creating copy restrictive media as in claim 1 wherein said focused micro-light sources form micro-spots at a surface of said media which have a diameter of less than approximately 0.3 mm.

24. An apparatus for creating copy restrictive media as in claim 1 wherein said micro-spots are spaced at a distance of at least 0.5 mm center-to-center.

25. An apparatus for creating copy restrictive media as in claim 1 wherein said micro-light sources are spaced along a line and pulsed to produce a pattern that can be detected by a microprocessor using a discrete Fourier transform of a digital signal produced by an electro-optical image scanner.

26. An apparatus for creating copy restrictive media comprising:

a light beam;

a light modulator which temporally modulates the intensity of said light beam;

a bundle of optical fibers for intercepting said light beam and dividing said light into at least two separate sources of light exiting at least two distal ends of said optical fibers;

an alignment of the optical axes at the distal ends of the optical fibers into a linear sparse array at a common plane:

a same number of identical focusing lenses with a focal plane and optical axes common to the common plane and optical axes, respectively, of the distal ends of said optical fibers: and a Dammann filter positioned adjacent each focusing lens for forming at least two micro-spots along a line wherein said micro-spots are formed onto a media.

27. An apparatus for creating copy restrictive media as in claim 26 wherein said beam of light is from a laser.

28. An apparatus for creating copy restrictive media as in claim 26 wherein the light modulator periodically exposes a row of micro-spots onto the media to enable writing to the media a unique pattern.

29. An apparatus for creating copy restrictive media as in claim 26 wherein the light modulator aperiodically exposes a row of micro-spots onto the media to enable writing to the media a unique pattern.

30. An apparatus for creating copy restrictive media as in claim 26 wherein said beam of light is blue.

31. An apparatus for creating copy restrictive media as in claim 26 wherein said media moves perpendicular to the linear sparse array of at least two light sources.

32. An apparatus for creating copy restrictive media as in claim 26 wherein an encoder turns said modulator on and off at regular intervals relating to movement of said media.

33. An apparatus for creating copy restrictive media comprising:

a light beam;

a light modulator which temporally modulates the intensity of said light beam;

a bundle of optical fibers for intercepting said light beam and dividing said light into at least two separate sources of light exiting at least two distal ends of said optical fibers;

an alignment of the optical axes at the distal ends of the optical fibers into a linear sparse array at a common plane: and a same number of identical focusing lenses with a object plane and optical axes common to the common plane and optical axes, respectively, of the distal ends of said optical fibers.

34. An apparatus for creating copy restrictive media as in claim 33 wherein said beam of light is from a laser.

35. An apparatus for creating copy restrictive media as in claim 33 wherein the light modulator periodically exposes a row of micro-spots onto the media to enable writing to the media a unique pattern.

36. An apparatus for creating copy restrictive media as in claim 33 wherein the light modulator aperiodically exposes a row of micro-spots onto the media to enable writing to the media a unique pattern.

37. An apparatus for creating copy restrictive media as in claim 33 wherein said beam of light is blue.

38. An apparatus for creating copy restrictive media as in claim 33 wherein said media moves perpendicular to the linear sparse array of at least two light sources.

39. An apparatus for creating copy restrictive media as in claim 33 wherein an encoder turns said modulator on and off at regular intervals relating to movement of said media.

40. An apparatus for creating copy restrictive media comprising:

a light beam;

a light modulator which temporally modulates the intensity of said light beam;

a scanning means which deflects said modulated beam; and a lens which focuses said deflected beam of light onto a media to form a linear sparse array of micro-spots on said media.

41. An apparatus for creating copy restrictive media as in claim 40 wherein said media moves perpendicular to the direction of linear scanning.

42. An apparatus for creating copy restrictive media as in claim 40 wherein an encoder turns said modulator on and off at regular intervals relating to movement of said media.

43. An apparatus for creating copy restrictive media as in claim 40 wherein said light beam is from a laser.

44. An apparatus for creating copy restrictive media as in claim 40 wherein the light modulator periodically exposes a sequence of micro-spots onto the media to enable writing to the media a unique pattern.

45. An apparatus for creating copy restrictive media as in claim 40 wherein the light modulator aperiodically exposes a sequence of micro-spots onto the media to enable writing to the media a unique pattern.

46. An apparatus for creating copy restrictive media as in claim 40 wherein said light beam is blue.

47. An apparatus for creating copy restrictive media as in claim 40 wherein said scanning means is a polygon.

48. An apparatus for creating copy restrictive media as in claim 40 wherein said scanning means is a galvanometer.

49. An apparatus for creating copy restrictive media as in claim 40 wherein said lens means is an f-theta lens.

* * * * *